US011346621B2

(12) United States Patent
Huang

(10) Patent No.: US 11,346,621 B2
(45) Date of Patent: May 31, 2022

(54) RECOILLESS APPARATUS FOR GUNS

(71) Applicant: Zhisong Huang, Fremont, CA (US)

(72) Inventor: Zhisong Huang, Fremont, CA (US)

( * ) Notice: Subject to any disclaimer, the term of this patent is extended or adjusted under 35 U.S.C. 154(b) by 0 days.

(21) Appl. No.: 17/100,862

(22) Filed: Nov. 21, 2020

(65) Prior Publication Data

US 2022/0120523 A1 Apr. 21, 2022

Related U.S. Application Data

(60) Provisional application No. 63/094,835, filed on Oct. 21, 2020.

(51) Int. Cl.
*F41A 1/10* (2006.01)
*F41A 1/08* (2006.01)

(52) U.S. Cl.
CPC ..... *F41A 1/10* (2013.01)

(58) Field of Classification Search
CPC ..... F41A 1/08; F41A 1/10
See application file for complete search history.

(56) References Cited

U.S. PATENT DOCUMENTS 1,108,715 A * 8/1914 Davis ..... F41A 1/10 89/1.701
1,108,716 A * 8/1914 Davis ..... F41A 1/10 89/1.702
1,108,717 A 8/1914 Davis
3,633,509 A * 1/1972 Grandy ..... F42B 12/60 102/338
4,126,078 A * 11/1978 Ashley ..... F41A 1/04 102/440
4,452,123 A * 6/1984 Holtrop ..... F41A 1/08 89/1.706
5,313,870 A * 5/1994 Clark ..... F41A 1/10 89/1.701
5,357,841 A * 10/1994 Clark ..... F41A 1/08 89/1.701
7,418,896 B1 * 9/2008 Dindl ..... F41A 1/10 102/437
7,624,668 B1 12/2009 Sanford
7,814,696 B2 * 10/2010 Rapp ..... F42B 5/035 42/84
7,997,179 B1 8/2011 Nelson et al.
2011/0296977 A1 * 12/2011 Regebro ..... F41A 1/10 89/1.701
2020/0200499 A1 * 6/2020 Lindstrom ..... F41A 21/30
2021/0131756 A1 * 5/2021 Shaughnessy ..... F41A 1/10

* cited by examiner

*Primary Examiner* — Derrick R Morgan
(74) *Attorney, Agent, or Firm* — Schwegman Lundberg & Woessner, P.A.

(57) ABSTRACT

The invention relates to a recoilless apparatus for firing conventional cartridge-based ammunitions comprising a gun barrel and a compensating mass launch tube wherein a projectile is accelerated in one direction inside said gun barrel counterbalanced by a compensating mass accelerated in the opposite direction inside said launch tube thereby minimizing recoil and further providing means of automatic ammunition handling.

14 Claims, 5 Drawing Sheets

RECOILLESS APPARATUS FOR GUNS

CROSS-REFERENCE TO RELATED APPLICATIONS

This application claims the benefit of U.S. Provisional Application No. 63/094,835 filed Oct. 21, 2020, which is incorporated herein by reference.

FIELD OF THE INVENTION

The present invention relates to ordnance, ammunition and firearms. Particularly, the invention relates to recoilless projectile launching systems using techniques of explosives-propelled compensating masses. More particularly, the invention relates to a device that can be used to fire conventional cartridge-based ammunitions automatically producing substantially no recoil.

BACKGROUND OF THE INVENTION

Firing a gun is well known to produce a recoil owing to the principle that an action always produces a counteraction. During the process of a gun firing, the cartridge casing seals the breach end of a gun barrel, forcing both the projectile and gasified propellant to fly towards the muzzle. Recoil of the gun body is the eventual counteraction to the movement of said projectile. The recoil can degrade targeting accuracy of fast consecutive shooting as well as balance of the weapon holder. For the emerging small-form-factor robotic systems used in law enforcement and armed forces, eliminating recoil of firearms is becoming very desirable for applications using these light weapon carriers, especially small aero drones. It is further desirable for these recoilless weapons to be capable of automatic ammunition handling and firing.

Recoilless rifles in use today are based on the technique of explosives-propelled compensating masses. An earliest example was U.S. Pat. No. 1,108,717 wherein a modified cartridge was placed in the middle of a continuous single launch tube open at both ends. The modified cartridge had an opening at the rear of the casing and enabled propellant gas to rush backwardly. Additionally, compensating mass materials comprising wads of felt replaced some original gunpowder inside the rear portion of the cartridge. When ignited by an electrical trigger, a projectile was propelled towards the muzzle direction while the compensating materials and at least parts of the gasified propellant rushed in the opposite direction. If properly balanced, the launch was recoilless. Weapons based on this design are often referred to as Davis Gun, named after its inventor.

U.S. Pat. No. 7,814,696 also utilized a single continuous launch tube with openings at both ends. Additionally, an impermeable solid divider was placed inside the middle of the tube. On the muzzle section of the divided tube was placed a first propellant charge against the divider with a first projectile overlaying the first charge. On the breech section of the tube was placed a second charge against said divider, overlayed by a second projectile. Separately, these two charges were ignited electrically, but substantially simultaneously. Once triggered, the first projectile was propelled towards the muzzle, balanced by said second projectile flying towards the breech. Said recoilless device was designed to operate under water.

U.S. Pat. No. 7,418,896 utilized a single continuous launch tube with openings at both ends at least immediately prior to and in the duration of the firing. With a specially designed munition placed inside the middle section for said tube, when fired, said explosion propelled a projectile towards the muzzle counter-balanced by a ballast moving towards the breech end.

U.S. Pat. No. 7,997,179 utilized two tubes which can be separated for ammunition handling and/or other purposes but nevertheless rejoined prior to firing, forming in effect a single continuous launch tube in at least the duration of ammunition firing. A single charge was placed in the middle of said tube, propelling two payloads simultaneously in opposite directions upon ignition. A payload (a water bomb) was delivered to a target without recoil by use of said apparatus.

U.S. Pat. No. 7,624,668 also utilized a single continuous launch tube with openings at both ends. A munition was placed near the breech end of said tube. The munition consisted of a projectile, a casing with a nozzle opening at its rear and a propellant powder inside said casing. When ignited, the projectile was propelled towards the muzzle direction while the propellant gas rushed through said nozzle towards the breech opening. In such a case, said propellant gas acted as the compensating mass. The launch tube experienced no recoil. Weapons based on this design are often called "Recoilless Rifles" and are in common usage.

It is not practical to put an ammunition loader in the space immediately behind breech ends of these launch tubes in the path of the compensating mass movements and/or propellant gas flows due to their violent nature. Additionally, ammunitions often need to be placed deep inside these launch tubes, further complicating loading/unloading tasks. Recoilless rifles are commonly operated manually, wherein an ammunition is manually inserted and secured inside the tube prior to firing and spent shells manually extracted after the firing.

Some recoilless rifles can be operated automatically, utilizing ammunition handling techniques analogous to those used in a revolver. A chamber is rotatably detached from a launch tube and an ammunition is inserted into the chamber. The chamber is then reattached to the tube prior to firing. Spent shell casings are later extracted from the detached chamber after firing. A known example is a Rheinmetall™ RMK30 auto-cannon, which further utilized a special caseless ammunition to eliminate need for extracting spent shells. U.S. Pat. No. 4,452,123 utilized a special composite ammunition, wherein sidewall of the ammunition is strong enough to also serve as part of the gun barrel. The patent further utilized a steel liner lining the inside of the gun barrel to mitigate barrel erosion issues. Accurate alignment of the load chamber, and hence the loaded ammunition, with the gun barrel reliably and repeatably over many firing cycles is required when utilizing these techniques. Poor alignment can lead to targeting inaccuracy and gun barrel erosion issues. Adopting these complex loading systems for large-scale use in small arms seems challenging.

Guns used to fire conventional cartridge-based ammunitions are capable of automatic ammunition handling. However, these guns are not recoilless. Several techniques are in use to reduce their recoil, including muzzle brakes and barrel porting. There are, however, practical limits as to the magnitude of recoil reduction achievable using these techniques. These measures typically reduce recoil but do not eliminate it. Various other mechanical devices can also be used to re-distribute recoil impact over a longer time duration thus reducing "felt recoil" but these methods do not eliminate recoil owing to the law of conservation of momentum. There is therefore a need for additional alternative methods that can be used to launch a bullet without recoil and provide automatic ammunition handling at the same time, for applications in small arms particularly.

The present invention is based on several considerations. First, it is known that recoil-based breech loading is an effective automatic ammunition handling method. Secondly, open chamber ammunition loading technique, relatively simple and light weight, is a suitable technique to use in launching a non-abrasive compensating mass and/or a propellant gas, since chamber-barrel alignment requirements need not be very strict and barrel erosion issue is mitigated in this application. Thirdly, muzzle brakes are known to reduce recoil of gun barrels. Finally, explosive-propelled compensating mass techniques are proven to be capable of substantially eliminating recoil. A combination of these considerations is utilized in the present invention to provide a recoilless apparatus capable of automatic ammunition handling.

BRIEF SUMMARY OF THE INVENTION

It is the object of the present invention to provide an apparatus capable of firing conventional cartridge-based ammunitions without recoil, and of firing these ammunitions consecutively and automatically.

The present invention comprises a novel device in which a gun barrel and a compensating mass launch tube, each pointing in an opposite direction, are supported coaxially linearly breech-to-breech during at least the gun firing, using a fixture. Each said barrel and launch tube is open at each breech end and muzzle end. Sufficient gap in space is allocated between said breech ends such that an automatic ammunition handling device, comprising means for breech loading and/or unloading of ammunitions and ammunition triggering, can be mated to each said barrel/tube. A cartridge is placed inside said gun barrel at its breech end and further seals said breech end. A compensating mass package comprising a charge or a compensating mass overlaying a charge is placed inside a loading chamber attached to said launch tube at its breech end and further seals said breech end. A suitable amount of said charge is utilized in each cartridge and package such that each said barrel and launch tube produces substantially the same magnitude of recoil. A first loader is mated to said gun barrel providing means of loading and/or unloading of said cartridge, wherein said loader is powered generally by recoil resulting from firing of said cartridge. A second loader is mated to said launch tube, providing means of loading and/or unloading said compensating package. An ignition device is provided whereby charges inside said cartridge and package are ignited substantially simultaneously or with a pre-determined time lag.

When charges inside said cartridge and package are ignited substantially simultaneously, a projectile is propelled to a target in the direction of said gun muzzle, compensated by movement of compensating masses going in the opposite direction inside said launch tube. While said gun barrel produces a recoil helping to extract spent shell casing from inside of said gun barrel and to power loading of a fresh cartridge into said gun barrel, said recoil is cancelled by counteracting recoil from said compensating mass launch tube leading to substantially no net recoil experienced by said fixture. A predetermined time lag between said two ignitions may also be employed to mitigate possible differences in time evolution of recoil experienced by said barrel relative to said launch tube.

A further object of the present invention is to minimize weight of the device needed to operate said compensating mass launch tube. The present invention utilizes a technique of open chamber cartridge loading and further comprises a novel half-obround cartridge and a loading chamber benefiting employment of said half-obround cartridges. Said half-obround cartridge comprises a shell casing, the exterior shape of which is characterized by a geometry of generally a half obround, wherein said geometry consists of a rectangular prism section and a semicylindrical section overlaying said prism section, and further includes a prism height substantially equal to radius of said semicylinder. Said shell casing further includes a cylindrical hollow section disposed coaxial to said semicylinder. Suitable gunpowder and a primer may be contained in said hollow section. Said half-obround geometry permits lateral cartridge insertion for benefits of open chamber loading operations and at the same time closely resembles a right circular cylinder. Needed casing material and therefore weight is minimized thereby.

Said loading chamber comprises a tunnel through which an ammunition carrier slider is moved slidably. Said tunnel is open at least at one longitudinal end. Sidewalls of said tunnel are characterized by: optionally an opening on a first vertical sidewall section for admitting a concussion firing pin; and a second opening on a second vertical section opposite to said first vertical section for connecting fixedly to said compensating mass launch tube, wherein said first, and second opening and launch tube are aligned to be coaxially linear thus forming part of said loading chamber. A slot opening is made on a first horizontal surface of said tunnel for admitting an ammunition from a magazine.

Said carrier slider is utilized for purpose of carrying an ammunition from stations of loading a cartridge to firing a cartridge and then unloading a spent shell. Said slider is characterized by a transverse cross-section substantially the same as that of said tunnel, such that each transverse sidewall surface of said slider is contiguous to each counterpart sidewall surface of said tunnel.

Transversely on a first horizontal face of said slider, a trench is formed for accepting an ammunition through said slot opening. Said trench is characterized by a geometry substantially the same as that of said half-obround cartridge exterior such that each sidewall surface of a loaded cartridge is contiguous to a counterpart surface of said trench and to said first horizontal surface of said tunnel. Said trench is suitably disposed in said slider such that, when suitably positioned at a station of firing a cartridge, semicylindrical section of said half-obround trench is aligned coaxially linear to said second launch tube, thereby completing formation of an enclosed loading chamber connected to said launch tube.

A recoil-reducing muzzle brake further included in said gun barrel reduces the size of needed compensating mass package and further reduces size of device launching said package, thereby further reducing weight of said recoilless apparatus.

Alternatively, the present invention comprises a novel device in which a first gun barrel for launching a projectile and a second gun barrel for launching a compensating mass, each pointing in an opposite direction, are supported breech-to-breech coaxially linearly during at least the gun firing, using a fixture. Each said barrel is open at each breech end and muzzle end. Sufficient gap in space is allocated between said breech ends, at least in the duration of said firing, such that an automatic ammunition handling device, comprising means of breech loading and/or unloading of ammunitions and ammunition triggering, can be mated to each said barrel. A first cartridge is placed inside said first gun barrel at its breech end and further seals said breech end. A second cartridge or blank cartridge is placed inside said second gun barrel at its breech end and further seals said breech end. A suitable amount of charge is contained in each said cartridge such that each said barrel produces substantially the same magnitude of recoil. A first loader is mated to said first gun barrel providing means of loading and/or unloading said first cartridge, wherein said loader is powered generally by recoil resulting from firing of said first cartridge. A second loader is mated to said second gun barrel providing means of loading/unloading said second cartridge or blank cartridge, wherein said loader is powered generally by recoil resulting from firing of said second cartridge or blank cartridge. An ignition device is provided whereby charges inside said cartridges are ignited substantially simultaneously or with a pre-determined time lag.

BRIEF DESCRIPTION OF THE DRAWINGS

Some embodiments of the present invention are illustrated as an example and are not limited by the figures of the accompanying drawings, in which like references may indicates similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a", "an" and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for sake of clarity, this description will refrain from repeating every possible combination of the individual steps in an unnecessary fashion. Nevertheless, the specification and claims should be read with the understanding that such combinations are entirely within the scope of the invention and claims. Novel recoilless gun apparatuses, devices and methods for constructing and operating such devices are discussed herein. In the following description, for purpose of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

Figure 1:
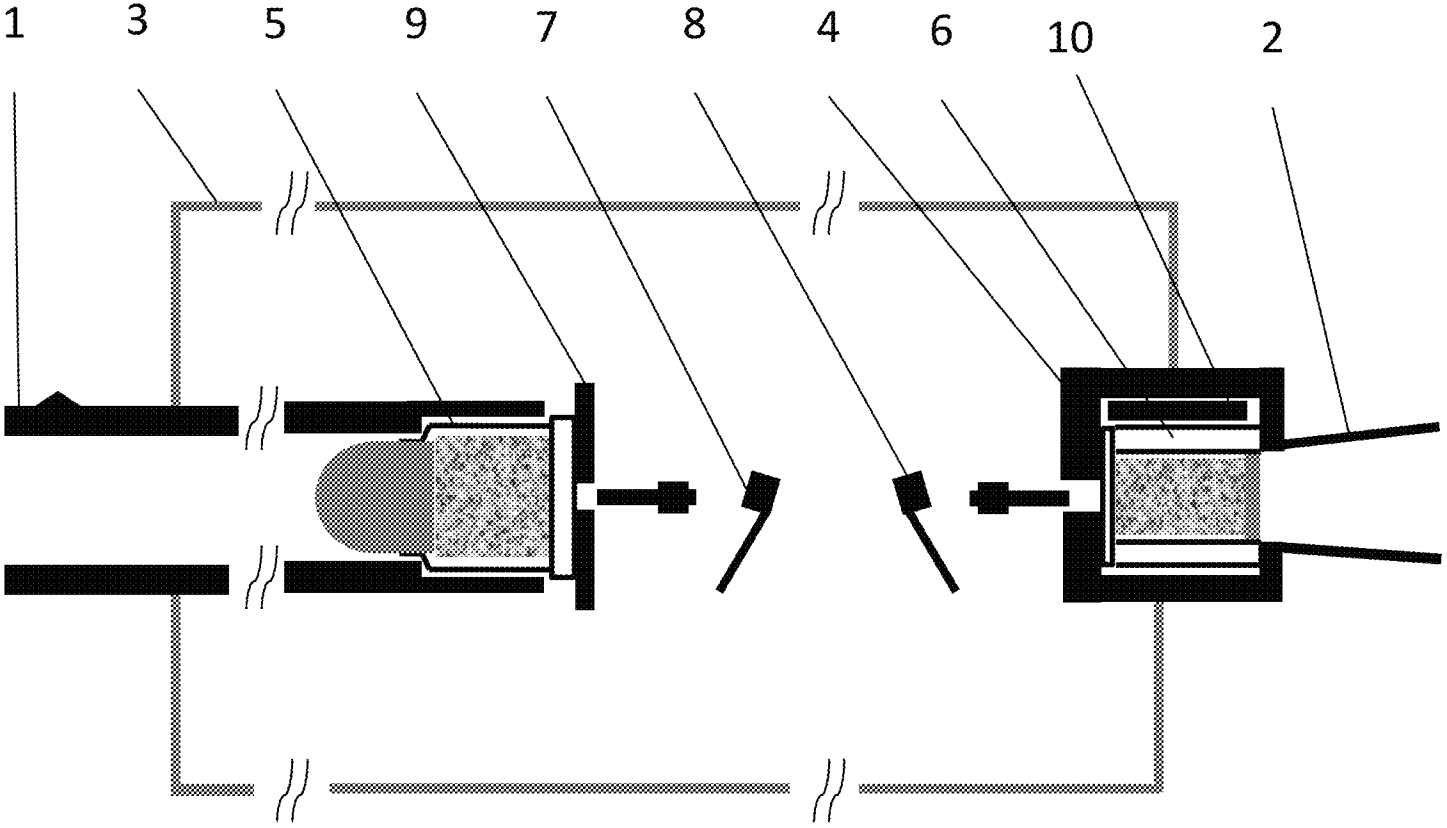
FIG. 1 is a schematic diagram of a recoilless apparatus for guns constructed in accordance with an embodiment of the present invention.

The present invention will now be described by referencing the appended figures representing preferred embodiments. All figures herein are not drawn to scale. As depicted in FIG. 1, the present invention comprises a novel device in which a gun barrels 1 and a compensating mass launch tube 2, each pointing in an opposite direction, are supported breech-to-breech substantially coaxially linearly during at least the firing, using a fixture 3. Herein, coaxial linearity refers to the geometric alignment wherein the axis of said barrel and tube coincide in a line. Each said barrel and tube is open at each breech end and muzzle end. Sufficient gap in space is allocated between said breech ends such that breech loading and/or unloading plus ammunition triggering can be accommodated for each said barrel and tube in at least the duration of said loading and/or unloading and in the duration of said ammunition firing. A compensating mass loading chamber 4 is further attached fixedly to breech end of said launch tube 2. Said gun barrel 1 is used to deliver a projectile to a target, while said launch tube 2 is used to supply needed compensating mass movement.

In a preferred embodiment, when loaded, a cartridge 5 sits inside said gun barrel 1 at its breech end, while a compensating mass blank cartridge 6 sits inside said loading chamber 4 at the breech end of said tube 2.

Gun barrel 1 is furnished with a hammer head 7 and tube 2 is furnished with a hammer head 8. Each said hammer head is connected to a pull trigger. Pulling of said triggers leads to firing of said cartridge and/or packages by means of concussion ignition. Barrel 1 is mated to a conventional cartridge handling and firing mechanism, the construction and operations of which are abundantly depicted in common literatures. During firing, high pressure propellant gas propels the projectile forward as well as expanding cartridge casing 5. This expansion helps sealing the breech end of said barrel 1. Near the end of firing, a recoil-powered mechanism comprising part 9 extracts the spent casing as well as loading a fresh cartridge. There are many different mechanical methods available by which an automatic ammunition handling is carried out most of which share the feature that the mechanical motions involved are initiated and energized by the gun firing. Said tube 2 is mated to an open chamber cartridge handling system comprising part 10 and is described subsequently.

Figure 2:
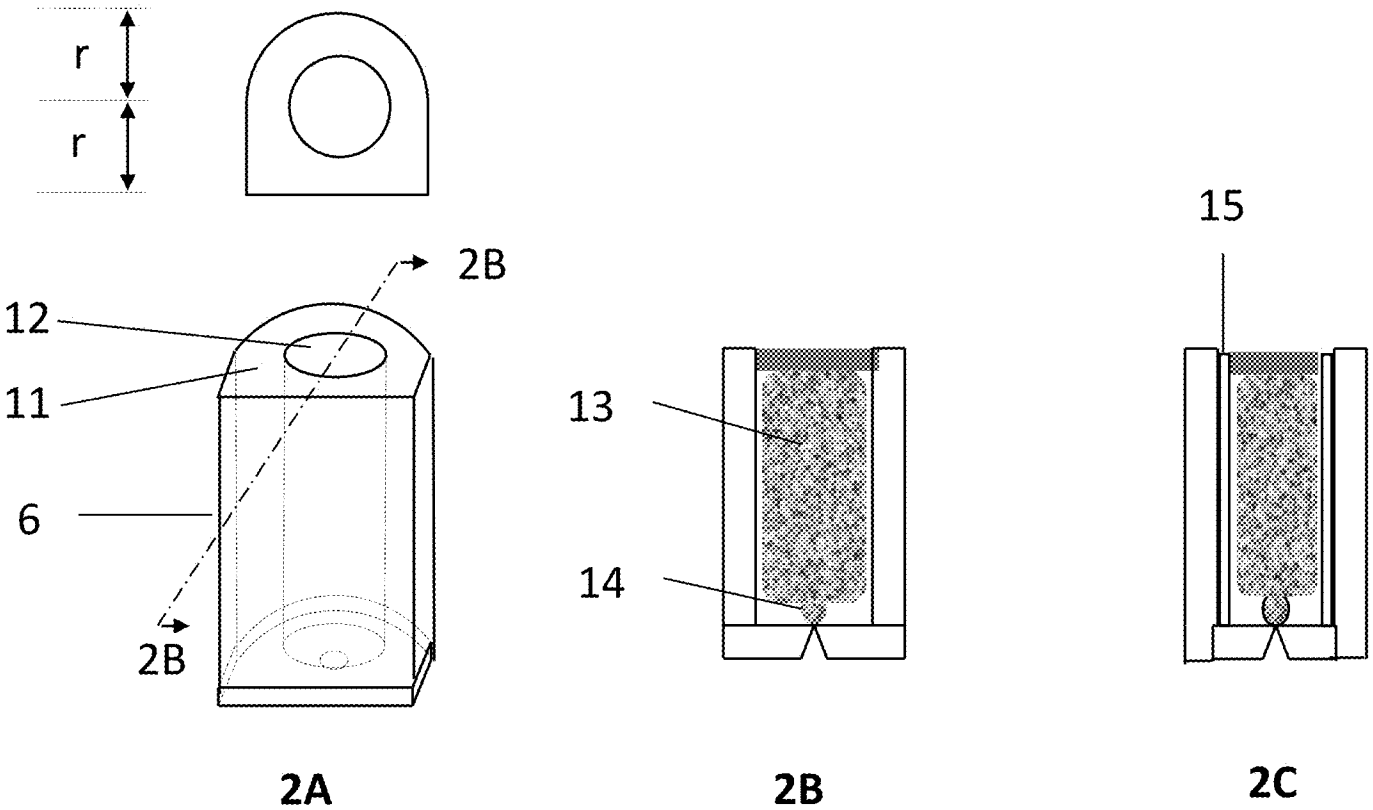
FIG. 2 is a schematic drawing of examples of a half-obround cartridge used for launching a compensating mass. Section 2A contains a perspective view and a top view of the cartridge. Section 2B is a cross-sectional view. Section 2C is a schematic cross-section view of a cartridge alternatively constructed in accordance with an embodiment of the invention.

Said compensating mass blank cartridge 6 is depicted in FIG. 2. Said cartridge 6 comprises a shell casing 11 the exterior geometry of which is characterized by that of a half-obround, consisting of a rectangular prism section and a semicylindrical section overlaying said prism section, wherein height of said prism is further equal to radius of said semicylinder as indicated in section 2A of FIG. 2. Said casing 11 further comprises a cylindrical hollow section 12, in which a gun powder 13 and a primer 14 may be contained as depicted in section 2B. Said cylindrical hollow section 10 is further disposed to be coaxial with said semicylinder. In another preferred embodiment, as depicted in section 2C, said cartridge 6 further comprises a conventional cylindrical cartridge 15 inserted into said hollow section. In preferred embodiments, said casing material 11 comprises a polymer.

Figure 3:
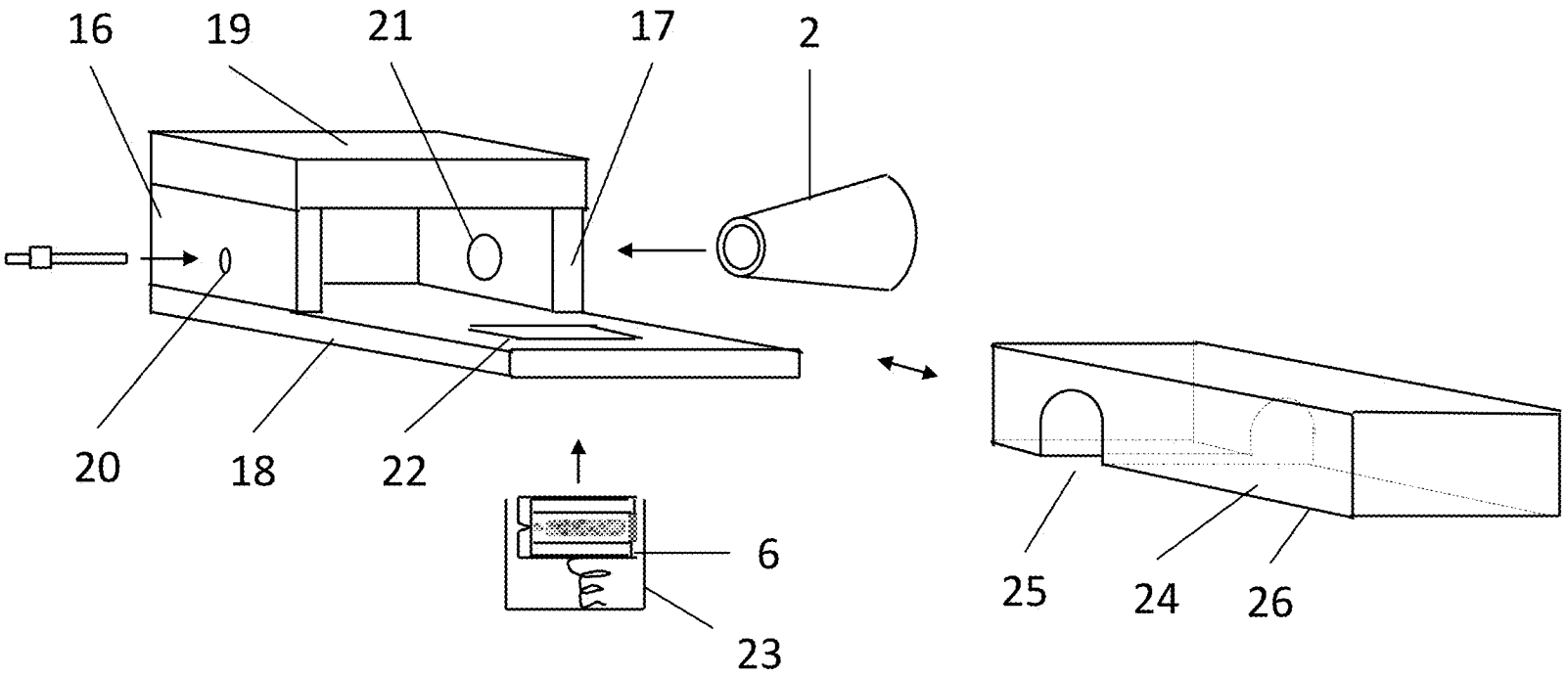
FIG. 3 is a schematic drawing of one example of a loading chamber and a compensating mass launch tube to which said loading chamber is attached. Some of the components are displayed in a disassembled state.

FIG. 3 depicts details of said loading chamber 4. In preferred embodiments, said loading chamber 4 comprises: a tunnel open at both longitudinal ends; and a first vertical sidewall 16; and a second vertical sidewall 17; and a first horizontal sidewall 18; and a second horizontal sidewall 19. A small hole 20 is formed on sidewall 16 for admitting a concussion firing pin. A larger circular opening 21 is formed on sidewall 17 for connecting fixedly to said launch tube 2. Openings 20, 21 and tube 2 are disposed to be coaxially linear. A slot opening 22 is further formed on sidewall 18 whereby loading of a cartridge 6 from a magazine 23 can be accomplished.

A carrier slider 24 is utilized for purpose of ammunition loading and/or unloading. Said slider is moved slidably longitudinally inside said tunnel, carrying a half-obround cartridge 6 held inside a trench 25 formed transversely on a first horizontal surface 26 of said slider. Transverse cross-section of said slider is characterized by an exterior dimension the same as that of said tunnel such that each sidewall surface of said slider is contiguous to a counterpart sidewall surface of said tunnel. Trench 25 is characterized by a geometry and dimension the same as that of said half-obround cartridge such that each sidewall surface of a loaded cartridge is contiguous to a counterpart surface of said trench and said first horizontal surface 18 of said tunnel. Said trench 25 is further transversely disposed in said slider such that semicylindrical section of said trench 25 is coaxially linear to said tube 2 when positioned at a station of firing, thereby completing formation of an enclosed loading chamber 4.

In one preferred embodiment, said tunnel is longitudinally linear. Said tunnel sidewalls are therefore suitably planar. Counterpart surfaces of said slider and half-obround cartridge are accordingly planar to maintain contiguity. In another preferred embodiment, said tunnel is arced longitudinally, in which case relevant sidewalls of the tunnel, slider and cartridge are accordingly arced to maintain contiguity.

Figure 4:
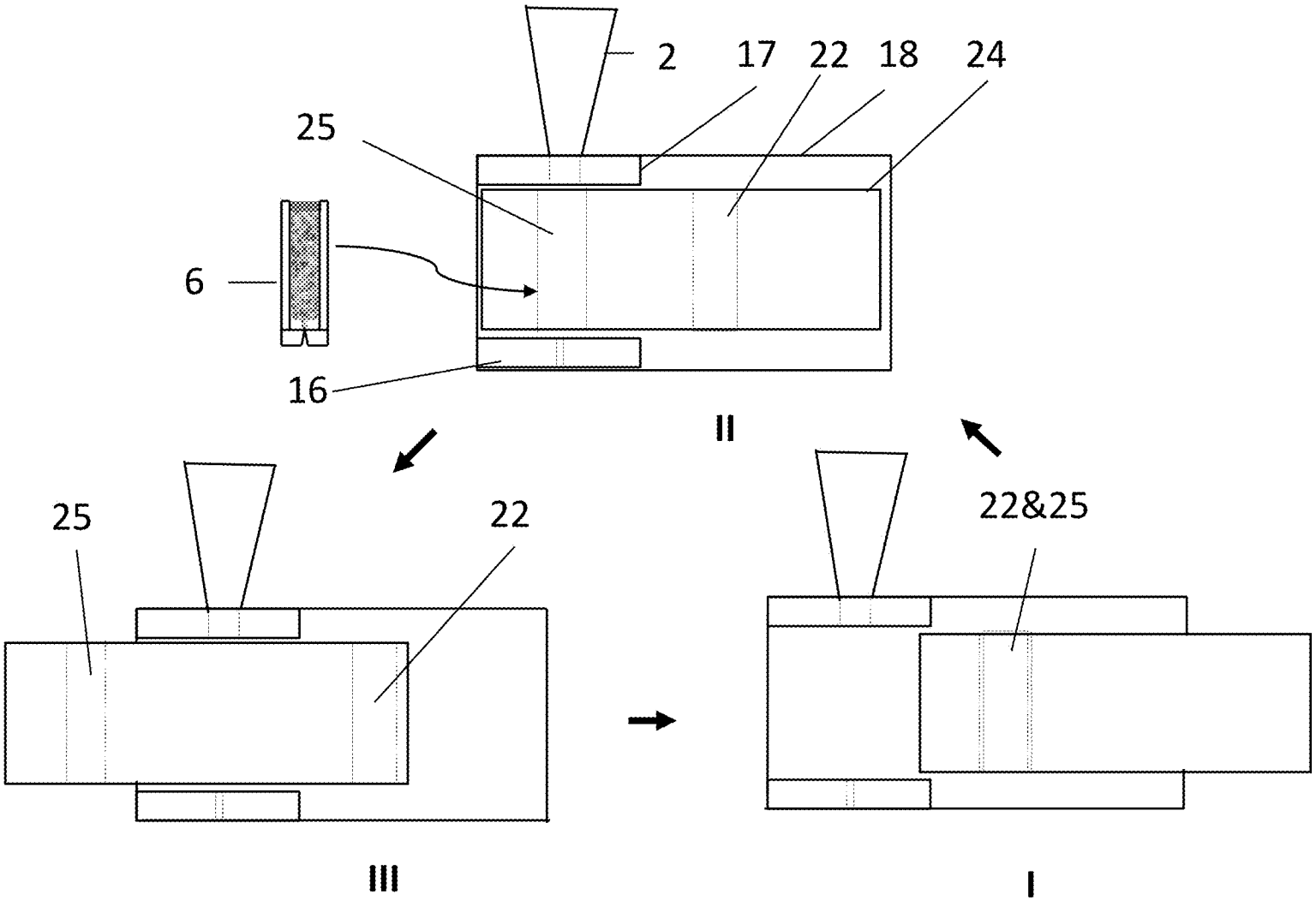
FIG. 4 is a schematic drawing of one example of top-down view of the loading chamber showing the carrier slider at stations of ammunition loading (I), firing (II) and unloading (III) respectively. Some components are shown in a disassembled state. A top horizontal sidewall 19 and a cartridge 6 carried by the slider further are not shown.

FIG. 4 depicts an example of loading chamber 4 wherein carrier slider 24 is positioned at stations of loading (I) a cartridge, firing (II) a cartridge and unloading (III) a spent shell respectively. Cartridge 6 is carried by said slider 24 but not displayed for sake of clarity. At station (I), slot 22 and trench 25 are lined up and a cartridge 6 is laterally inserted into trench 25. Slider 24 is then moved to station (II) carrying the loaded cartridge into coaxially linear alignment with launch tube 2. Front surface of said cartridge 6 is contiguous to tunnel sidewall 17 and rear surface of said cartridge is further contiguous to sidewall 16, thereby sealing breech end of launch tube 2. After launching, slider 24 is moved to station (III) for ejection of spent shell casings. A new cycle can start after a slider 24 is positioned again at station (I). In preferred embodiments, only one slider is included. Alternatively, multiple sliders may be chained together for faster executions and may further be moved in a circular loop.

In one preferred embodiment, means are provided whereby automatic operations comprising ammunition handling of said launch tube 2 are initiated and energized by its own launch recoil. In another preferred embodiment, means are provided whereby automatic operations of launch tube 2 are initiated and energized by an external electric power source. In a more preferred embodiment, launch tube 2 is slaved to said gun barrel 1 and means are provided whereby automatic operations of said tube are initiated and energized by recoil from firing of said gun 1.

An object of said fixture 3 is to maintain coaxial linearity of said gun barrel and launch tube. For launching a large bore high impact projectile, requirements for structural integrity of the fixture could be impractically high and failures in ignition synchronization of two separate charges could produce catastrophic recoil impact on the weapon holder. For launching smaller caliber projectiles, on the other hand, maintaining structural integrity is feasible with existing construction materials and relatively small imbalance caused by occasional failures in firing synchronization is tolerable. Relatively large movement along said coaxial axis may be permitted, should such benefits shock absorption. It is known that a major recoil shock happens the moment the supersonic projectile and gaseous propellant leaves the barrel and/or launch tube at muzzle points. In one preferred embodiment, said fixture 3 connects said gun barrel and launch tube via contacts near muzzle points and further utilizes appropriate shock absorbing mechanisms contained in said fixture. Said shock absorbing mechanisms may include elastomers, springs and various other shock-absorbers. In another preferred embodiment said barrel/launch tube are further connected via contacts near breech points, taking advantage of shock absorbers already built into existing guns.

A recoil-reducing muzzle brake further included on said gun barrel 1 further reduces the size of needed compensating mass package and reduces size of needed device launching said package, thereby further reducing weight of said recoilless apparatus. Commercial muzzle brakes are widely available and can be chosen for this purpose.

Figure 5:
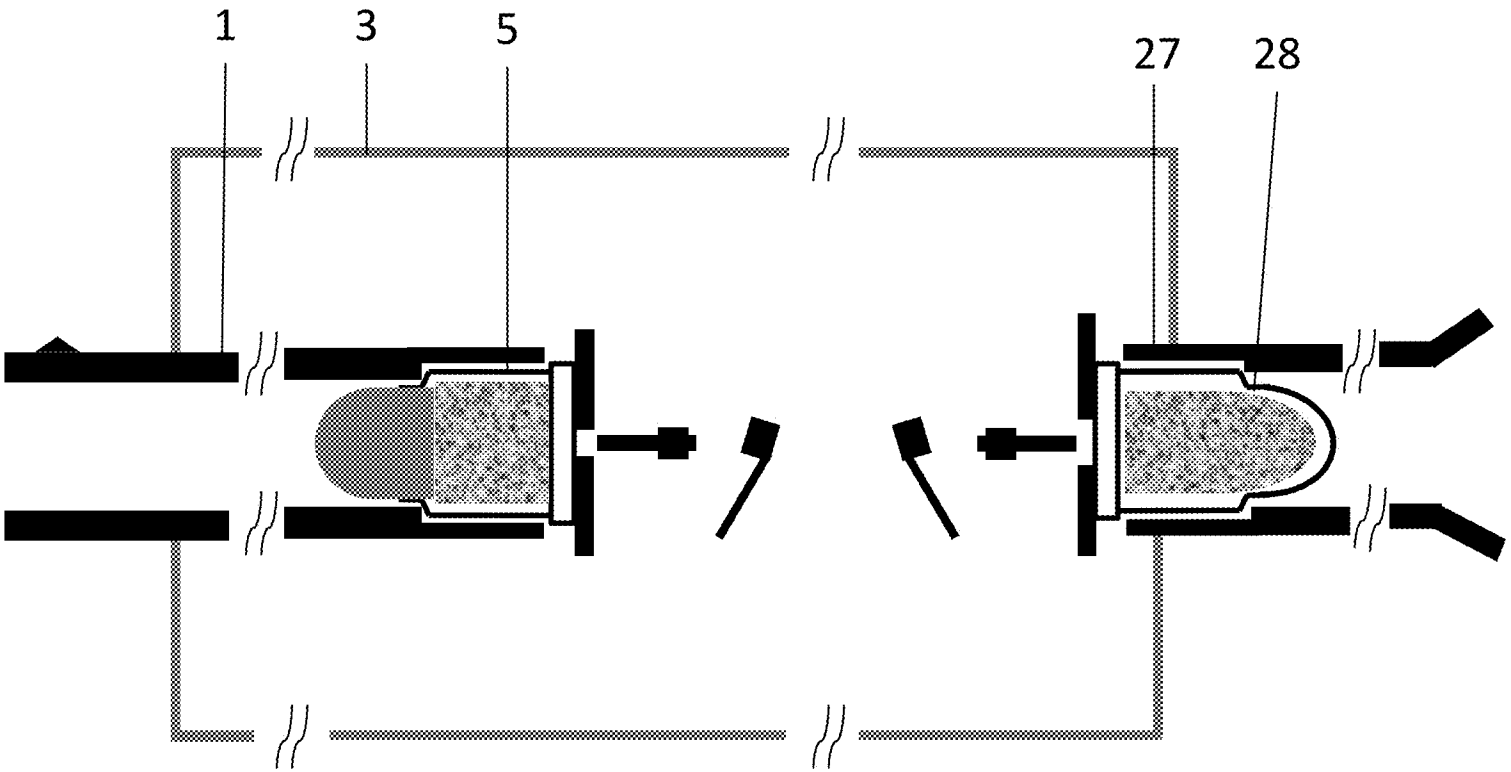
FIG. 5 is a schematic diagram of a recoilless apparatus for guns constructed in accordance with an alternative embodiment of the present invention.

FIG. 5 is a schematic diagram of a recoilless apparatus for guns in accordance with an alternative embodiment of the present invention. In this embodiment, a first gun barrel 1 for launching a projectile and a second gun barrel 27 for launching a compensating mass, each pointing in an opposite direction, are supported breech-to-breech coaxially linearly during at least the gun firing, using a fixture 3. Each said barrel is open at each breech end and muzzle end. Sufficient gap in space is allocated between said breech ends, at least in the duration of the gun firing, such that an automatic ammunition handling device, comprising means for breech loading and/or unloading of ammunitions and ammunition triggering, can be mated to each said barrel. A first cartridge 5 is placed inside said first gun barrel 1 at its breech end and further seals said breech end. A second cartridge or blank cartridge 28 is placed inside said second gun barrel 27 at its breech end and further seals said breech end. A first loader is mated to said first gun barrel providing means of loading and/or unloading of said cartridge, wherein said loader is powered generally by recoil resulting from firing of said cartridge 5. A second loader is mated to said second gun barrel providing means of loading and/or unloading of said cartridge or blank cartridge, wherein said loader is powered generally by recoil resulting from firing of said cartridge or blank cartridge 28. An ignition device is provided whereby charges inside said cartridges is ignited substantially simultaneously or with a pre-determined time lag. A timing device is provided supplying suitable means of adjusting said time lag.

In preferred embodiments, each gun barrel is associated with a hammer head. Each said hammer head is connected to a pull trigger. The pulling of said trigger leads to firing of said cartridge by means of concussion triggering. Each pull trigger is operated by an electronic actuator, which pulls the trigger upon receiving an electric pulse. An electronic device provides electric pulses for each actuator simultaneously or with a pre-determined time lag. In one preferred embodiment, both guns are fired simultaneously. In another preferred embodiment, the second gun is fired with a time delay relative to the first gun such that the first projectile already moves outside the barrel before the second gun is fired.

Many automatic ammunition handling devices and/or mechanisms are commercially available for guns and they can be chosen for this purpose. In preferred embodiments, each gun barrel is mated to an automatic ammunition loader wherein operations of each loader are initiated and energized by firing of each respective gun. In a more preferred embodiment, loader operations of the second barrel are slaved to the first barrel, and further are initiated and energized by firing of said first gun. Said first gun barrel may comprise a muzzle brake to further reduce its recoil thereby reducing size of said second gun barrel and additionally size of second cartridge or blank cartridge.

Recoilless apparatus depicted in FIG. 5 may utilize components that are currently in widespread use and have been proven reliable. Recoilless apparatus constructed in accordance with this alternative embodiment have an advantage of compatibility with existing logistics.

While this invention has been described in terms of what are at present believed to be the preferred embodiments, it will be apparent to those skilled in the art that various changes may be made to these embodiments without departing from the scope of present invention. For example, the current invention has been described utilizing an ammunition triggering method based on concussion. It will become obvious to one skilled in the art to recognize that the present invention can also be practiced utilizing an electrical triggering method. It is therefore intended that the appended claims cover all changes that fall within the scope of the present invention.

What is claimed is:

1. An apparatus comprising:

a gun barrel open at both ends; and a launch tube open at both ends, wherein said launch tube is not necessarily of the same dimension over the length of the launch tube and the launch tube is further disposed in:

an alignment which is substantially coaxially linear with said gun barrel; and an arrangement wherein a launch tube breech faces a breech of the gun barrel; and a position wherein a spatial gap exists between the breech ends of said gun barrel and launch tube; and a compensating mass loading chamber attached to the breech end of said launch tube; and a cartridge placed inside the breech section of said gun barrel, wherein said cartridge points in a direction of a muzzle of the gun barrel and during launching, the cartridge further seals said gun barrel breech end; and a compensating package comprising a charge or a compensating mass overlaying a charge, wherein said compensating package is placed inside said loading chamber;

and the compensating package points in a muzzle direction of said launch tube;

and the compensating package further seals said launch tube breech end during launching; and a first loader configured to automatically load and/or unload said cartridge; and a second loader configured to automatically load and/or unload said compensating package; and an ignition device configured to ignite charges contained inside said cartridge and said compensating package substantially simultaneously or with a predetermined time lag; and a fixture configured to physically support the plurality of components of said apparatus.

2. An apparatus as in claim 1, wherein said gun barrel further comprises a muzzle brake.

3. An apparatus as in claim 1, wherein said first loader further comprises utilizing energy generated from firing of said cartridge to initiate and energize loading and/or unloading of said cartridge.

4. An apparatus as in claim 1, wherein said second loader further comprises utilizing energy generated from firing of said cartridge, or an external electric energy source, to initiate and energize loading and/or unloading of said compensating package.

5. An apparatus as in claim 1, wherein methods of said ignitions comprises concussion firing and/or electrical firing.

6. An apparatus as in claim 1, wherein said compensating package further comprises a shell casing comprising:

an exterior shape of generally a half obround consisting of a rectangular prism section and a semicylindrical section overlaying said prism section, wherein height of said rectangular prism section further is generally the same as radius of said semicylindrical section; and a hollow cylindrical section open at both ends and further disposed coaxial to said semicylindrical section.

7. An apparatus as in claim 1, wherein said compensating mass loading chamber further comprises:

a tunnel open at least at one longitudinal end and further comprising:

a first opening on a first vertical section of tunnel sidewalls for admitting a concussion firing pin; and a second opening on a second vertical section of the loading chamber, opposite to and aligned with said first opening coaxially linearly and connected fixedly to said launch tube coaxially linearly; and a slot opening disposed transversely on a first horizontal section of the loading chamber for loading said compensating package from a magazine; and a carrier slider for transporting said compensating package inside said tunnel longitudinally and further comprising:

a transverse cross-section substantially the same as that of said tunnel such that each transverse sidewall surface of said slider is contiguous to each counterpart sidewall surface of said tunnel; and a trench for holding said compensating package, the trench formed transversely in said slider on a first horizontal face adjacent to said first horizontal section of said tunnel, wherein said trench further comprises:

a half obround geometry consisting of a rectangular prism section and a semicylindrical section overlaying said prism section, wherein height of said rectangular prism section further is generally the same as radius of said semicylindrical section; and an orientation wherein said semicylindrical section forms bottom of said trench; and a disposition in said slider such that said semicylindrical section is aligned coaxially linear to said second launch tube when said slider is suitably stationed; and said slider slidably moveable along a longitudinal path inside said tunnel; and said slider configured to be stationed at suitable locations along said tunnel path.

8. An apparatus as in claim 6, wherein said compensating package further comprises a cylindrical blank cartridge inserted into said hollow section such that outer sidewall surface of said blank cartridge is complimentary to inner sidewall surface of said hollow cylinder.

9. An apparatus as in claim 6, wherein said shell casing further comprises a polymer material.

10. An apparatus comprising:

a first gun barrel open at both ends; and a second gun barrel open at both ends, wherein said second barrel is not necessarily of the same dimension over the length of the second gun barrel and the second gun barrel is further disposed in:

an alignment which is substantially coaxially linear to said first gun barrel; and an arrangement wherein the second gun barrel breech faces a breech of the first gun barrel; and a position wherein a spatial gap between said two breech ends; and a first cartridge placed inside the breech section of said first gun barrel, wherein said cartridge points in a direction of a muzzle end of the first gun and during launching, the cartridge further seals said first gun breech end; and a second cartridge or blank cartridge placed inside the breech section of said second gun barrel, wherein said second cartridge or blank cartridge points in a direction of a muzzle end of said second gun barrel and during launching, the second cartridge or blank cartridge further seals said second gun barrel breech end; and a first loader configured to automatically load and/or unload said cartridge; and a second loader configured to automatically load and/or unload said second cartridge or blank cartridge; and an ignition device configured to ignite charges contained inside said cartridges substantially simultaneously or with a predetermined time lag; and a fixture configured to physically support the plurality of components of said apparatus.

11. An apparatus as in claim 10, wherein said first gun barrel further comprises a muzzle brake.

12. An apparatus as in claim 10, wherein said first loader further comprises utilizing energy generated from firing of said first cartridge to initiate and energize loading and/or unloading from the first loader.

13. An apparatus as in claim 10, wherein said second loader further comprises utilizing energy generated from firing of said second cartridge or blank cartridge to initiate and energize loading and/or unloading from the second loader.

14. An apparatus as in claim 10, wherein methods of said ignitions comprises concussion firing and/or electrical firing.

* * * * *